United States Patent [19]

Adebahr et al.

[11] 4,003,385

[45] Jan. 18, 1977

[54] METHOD AND MACHINE FOR MAKING CIGARETTES OR THE LIKE

[75] Inventors: Klaus Adebahr, Hamburg; Jurgen Gomann, Dassendorf, both of Germany

[73] Assignee: Hauni-Werke Korber & Co., KG, Hamburg, Germany

[22] Filed: Feb. 11, 1976

[21] Appl. No.: 657,239

[30] Foreign Application Priority Data

Feb. 18, 1974 Germany ..... 2506839

[52] U.S. Cl. ..... 131/84 B; 131/109 B; 131/110

[51] Int. Cl.[2] ..... A24C 5/18

[58] Field of Search ..... 131/84, 84 B, 81 A, 131/109 R, 109 B, 110, 61, DIG. 7, 110 A

[56] References Cited

UNITED STATES PATENTS

| | | | |
|---|---|---|---|
| 2,467,248 | 4/1949 | Arelt | 131/109 B |
| 3,542,037 | 11/1970 | Pietralunga | 131/109 B |
| 3,613,692 | 10/1971 | Gomann | 131/84 B |
| 3,779,253 | 12/1973 | Labbe | 131/110 |
| 3,844,295 | 10/1974 | David | 131/84 B X |
| 3,871,385 | 3/1975 | David | 131/84 B |

*Primary Examiner*—Stephen C. Pellegrino
*Attorney, Agent, or Firm*—Peter K. Kontler; John Kurucz

[57] ABSTRACT

Relatively small tobacco particles (including short tobacco and larger particles of tobacco dust) are extracted by suction from the tobacco filler stream in a cigarette making machine and are separated from the suction air stream or streams for immediate introduction into the magazine of the distributor or into the tobacco stream building zone of the machine. The separated particles are sprinkled by gravity onto the supply of tobacco in the magazine or are conveyed in a stream of compressed air which is admitted into the lower portion of the magazine or discharges the particles into the stream building zone so that the thus admitted particles form an intermediate layer of the filler stream.

22 Claims, 4 Drawing Figures

METHOD AND MACHINE FOR MAKING CIGARETTES OR THE LIKE

BACKGROUND OF THE INVENTION

The present invention relates to a method and machine or apparatus for making cigarettes or the like. More particularly, the invention relates to improvements in a method and machine for making a continuous tobacco filler stream which can be converted into or constitutes a rod-like filler ready to be draped into a web of cigarette paper or other wrapping material to form therewith a rod adapted to be subdivided into plain cigarettes, cigars or cigarillos of unit length or multiple unit length. Still more particularly, the invention relates to a method and machine for making a continuous tobacco filler stream by resorting to one or more streams of suction air.

A cigarette making machine comprises a distributor wherein a magazine accumulates and maintains a supply of tobacco which contains relatively large particles (primarily shredded tobacco leaf laminae but normally also some comminuted ribs, stem and/or birds' eyes) as well as relatively small particles including so-called short tobacco or tobacco shorts and larger and smaller particles of tobacco dust. The distributor comprises means for withdrawing from the supply a continuous layer of tobacco whose contents are thereupon classified according to size and/or weight (e.g., by a winnower) so as to segregate particles of rock, metal or other foreign matter as well as ribs, stem and birds' eyes. The remaining material of the layer is converted into a relatively wide layer or carpet whose leading edge is showered into a stream building or growing zone in which the particles of the layer are converted into the filler stream. Such stream is usually trimmed, once or repeatedly, to form a rod-like filler which is ready for wrapping into cigarette paper. As a rule, the making of a filler stream and filler involves the use of large quantities of suction air (i.e., air which is maintained at less than atmospheric pressure), for example, to attract the material of the filler stream and/or filler to conveyors which advance the stream and/or filler toward the wrapping station. The utilization of large quantities of suction air invariably entails segregation of short tobacco and/or tobacco dust which must be separated from the gaseous carrier medium for a number of reasons, i.e., in order to avoid contamination of the plant as well as to recover the segregated material, especially short tobacco and larger particles of tobacco dust because the presence of such material in the filler is not objectionable; on the contrary, such material is often desirable because it enhances the uniformity of weight and/or the filling power of the rod-like filler in a cigarette or the like.

In accordance with presently prevailing practice, the suction air stream or streams which are used in cigarette making machines are caused to pass through a relatively large, complex and expensive central filtering unit which removes the entrained smaller particles and permits the thus cleaned air to escape into the atmosphere. The removed material is thereupon processed (e.g., classified according to size) prior to reintroduction into the cigarette making machine. Such procedure is costly and the material which is segregated from air in the central filtering unit is likely to change its characteristics (size and/or moisture content) prior to reintroduction into the machine.

It was already proposed to remove relatively small particles of tobacco from tobacco supply in the magazine of the distributor in a cigarette making machine and to admit the thus removed particles into the shower which is fed into the stream building zone, or to convey the particles back into the magazine. Such proposals have met with limited success because the removal of relatively small tobacco particles from the magazine takes place by gravity or by mechanical means neither of which insures removal of appreciable quantities of short tobacco and/or tobacco dust and also because a machine utilizing such recovering device for short tobacco and tobacco dust must also employ at least one relatively large, bulky and expensive central filtering unit since the aforediscussed suction air streams invariably segregate substantial quantities of short tobacco and tobacco dust which must be recovered before the suction air stream is recirculated or permitted to escape into the atmosphere.

SUMMARY OF THE INVENTION

An object of the invention is to provide a method of making a continuous tobacco filler stream which renders it possible to recirculate at least the majority of relatively small tobacco particles which leave the tobacco path during the making of the filler stream without passing such relatively small particles through a filtering unit.

Another object of the invention is to provide a method which renders it possible to introduce short tobacco and/or larger particles of tobacco dust into those portions of the filler stream which are least likely to release the relatively small particles during further processing of the stream.

A further object of the invention is to provide a method which takes advantage of the filtering action of tobacco to insure satisfactory distribution and retention of short tobacco and/or acceptable particles of tobacco dust in the filler stream.

An additional object of the invention is to provide a method of recovering and recirculating acceptable tobacco shorts and particles of tobacco dust by resorting to relatively simple, compact and inexpensive apparatus.

A further object of the invention is to provide a method of the above outlined character which renders it possible to simplify the consturction of filtering units in machines for the making of cigarettes or other rod-shaped smokers' products.

Another object of the invention is to provide a cigarette making or like machine which embodies novel and improved means for intercepting and recirculating relatively small tobacco particles which leave the tobacco path during the making of a continuous tobacco filler stream with assistance from air which is maintained at subatmospheric pressure.

An ancillary object of the invention is to provide a cigarette maker with novel means for recovering tobacco particles from suction air streams which are used for or in connection with transport of tobacco during the making of plain cigarettes.

One feature of the invention resides in the provision of a method of making a continuous tobacco filler stream, e.g., a stream which can be trimmed in one or more stages for the purpose of converting it into a rod-like filler ready for draping into a web of cigarette paper or other wrapping material to form therewith a continuous rod adapted to be subdivided into plain cigarettes, cigars or cigarillos of unit length or multiple unit length.

The method comprises the steps of accumulating and maintaining — in a first portion of a predetermined path — a supply of tobacco which contains relatively large particles (such as shredded tobacco leaf laminae and eventually some fragments of tobacco stem, ribs and birds' eyes) and relatively small particles including short tobacco and larger and smaller particles of tobacco dust, withdrawing from the supply a continuous layer of tobacco and transporting the layer along a second portion of the path, showering the tobacco of the layer into an elongated stream building or growing zone which constitutes a third portion of the path to thereby convert the tobacco of the layer into the filler stream, conveying the filler stream lengthwise along the third and thereupon along a fourth portion of the path (the stream may be converted into a rod-like filler in the fourth portion of the path), conveying at least one suction air stream across at least one portion of the path whereby at least some relatively small particles of tobacco (i.e., short tobacco and/or smaller and larger particles of tobacco dust) become segregated from the remaining particles of tobacco in the one portion of the path and leave such one portion with the air stream, separating at least some relatively small particles from the air stream (such separating step preferably includes removing at least the majority of short tobacco and/or larger particles of tobacco dust), and introducing the thus separated relatively small particles directly into at least one selected portion of the path. The one portion is preferably the third and/or fourth portion, and the selected portion is preferably the first, second and/or third portion of the path.

The introducing step preferably comprises conveying the separated relatively small particles in a second air stream (preferably a stream of compressed air) and directing the second air stream against one side of tobacco in the selected portion of the path so that the air of the second air stream can pass through tobacco in the selected portion of the path and the tobacco filters the relatively small particles from the second air stream whereby such relatively small particles remain in the layer, shower or stream of tobacco which is transported along the selected portion of the path.

If the introducing step comprises conveying the separated relatively small particles in a compressed gaseous carrier medium (preferably air), the medium is preferably directed against the underside of tobacco supply in the first portion of the path so that the medium rises in and the tobacco of the supply intercepts the relatively small particles. Alternatively, the compressed gaseous carrier medium can be caused to introduce relatively small tobacco particles into the third portion of the path, i.e., into the stream building zone. Still further, the separated relatively small particles can be deposited, e.g., by gravity, on top of the supply in the first portion of the path; the filtering action of tobacco is then less pronounced but the relatively small particles are intimately intermixed with other particles of tobacco in the supply and/or layer before or not later than when the leading edge of the layer is showered into the stream building zone.

In each instance, the introduction of separated relatively small particles preferably includes admitting the separated particles into an intermediate part of the filler stream so that such particles are flanked by strata of relatively large particles not later than in the fourth portion of the path.

The method may comprise conveying one or more suction air streams across the third and fourth portions of the path, e.g., across the growing tobacco filler stream in the stream building zone and across the fully grown filler stream while the latter travels in the circumferential groove of a suction wheel and/or at the underside of a foraminous transfer conveyor.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
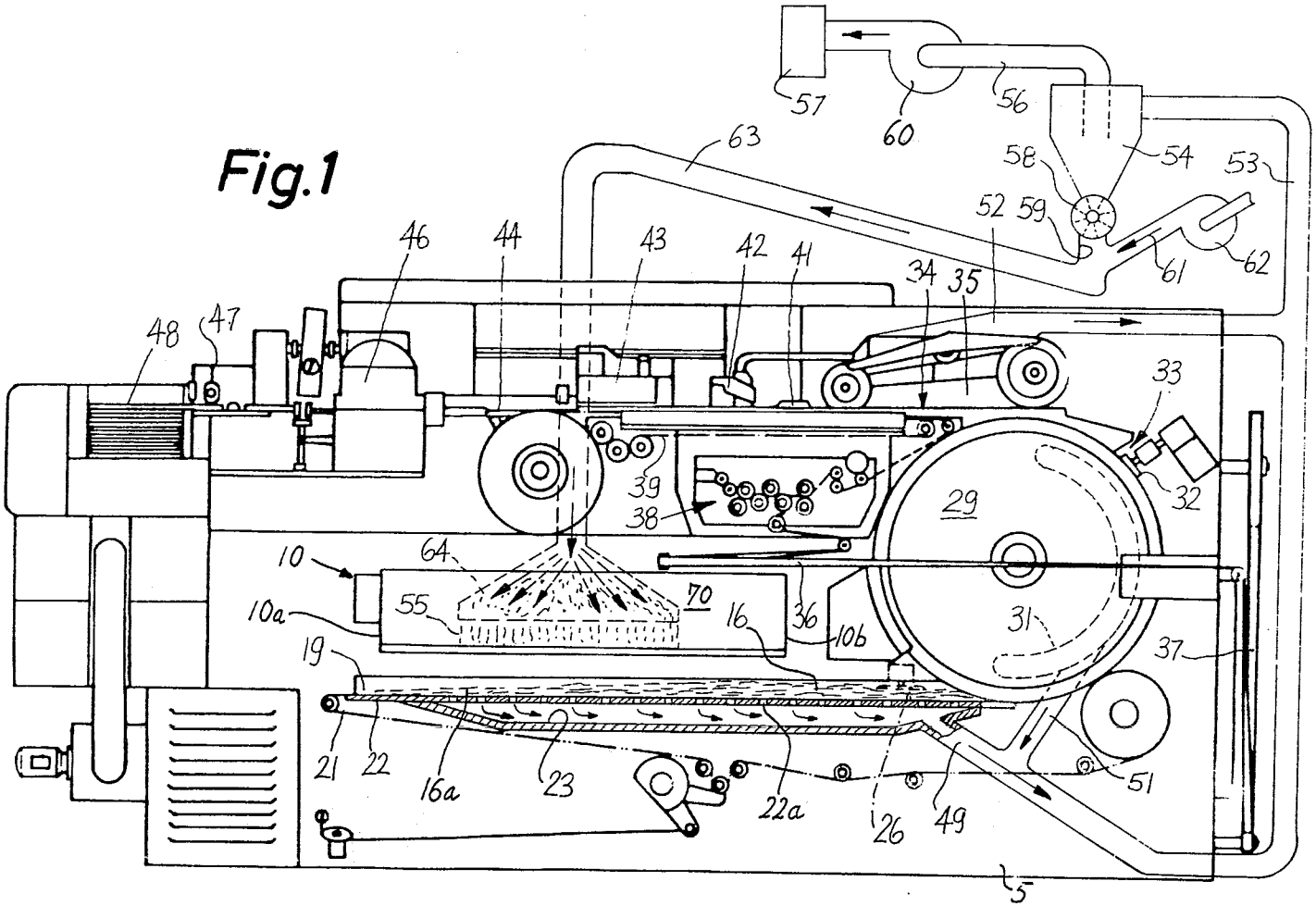
FIG. 1 is a schematic partly elevational and partly longitudinal vertical sectional view of a cigarette making machine which embodies the invention.
Figure 2:
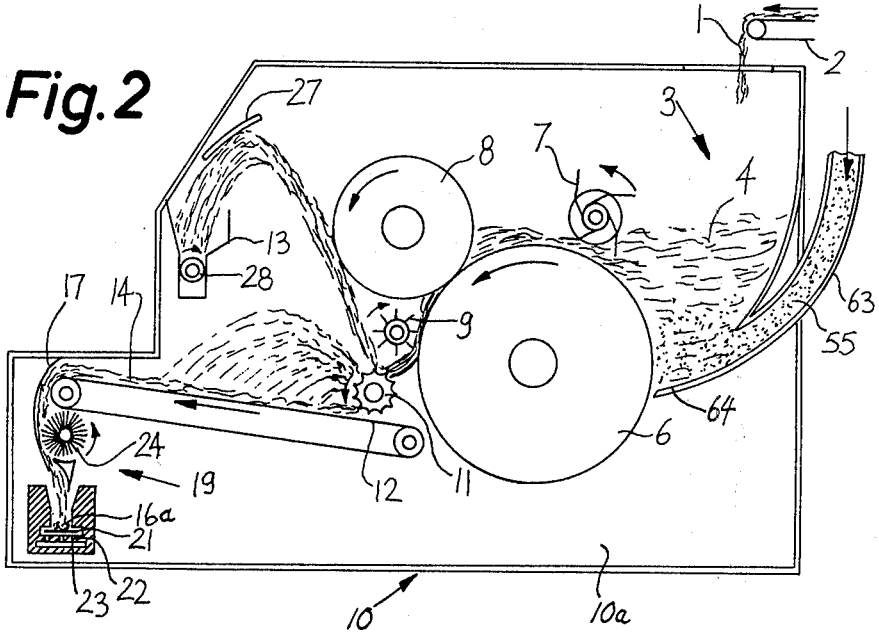
FIG. 2 is an enlarged transverse vertical sectional view of the distributor in the machine of FIG. 1.

Referring first to FIGS. 1 and 2, there is shown a cigarette making machine of the type known as GARANT (trademark) produced by Hauni-Werke Körber & Co. KG, of Hamburg-Bergedorf, Federal Republic Germany. The machine comprises a frame 5 which supports the housing 10 of a distributor. The latter comprises a magazine 3 for a supply 4 of tobacco 1 which is fed into the magazine by an endless belt conveyor 2, either continuously or at such intervals that the upper level of the supply 4 fluctuates little or not at all. Tobacco 1 contains shredded tobacco leaf laminae, comminuted tobacco stem, ribs and birds' eyes, so-called short tobacco as well as smaller and larger particles of tobacco dust. Additional tobacco dust and/or short tobacco is formed during conversion of tobacco which is being withdrawn from the magazine 3 into a continuous filler stream 16 shown in the lower part of FIG. 1.

The means for continuously withdrawing tobacco 1 from the supply 4 in the magazine 3 (the latter occupies a first portion of the tobacco path) comprises a rotary carded drum 6 which is driven to rotate in a counterclockwise direction, as viewed in FIG. 2, and transports a relatively thick layer of tobacco past a first refuser 7 here shown as a rotary paddle wheel which returns the surplus directly into the magazine 3 and thereupon past a second refuser 8 in the form of a carded drum. Tobacco which is allowed to advance beyond the second refuser 8 forms an equalized layer of substantial width which contains short and long shreds, larger and smaller particles of tobacco dust as well as comminuted ribs, stem and birds' eyes. A rapidly rotating picker roller 9 removes the equalized layer from the carding of the drum 6 and propels the thus removed tobacco into the range of a classifying device here shown as a rapidly rotating winnower 11 whose projections propel tobacco in several directions, depending upon the size and/or weight of the respective particles. The flight spans of heavier particles are longer and such particles are caused to impinge against a suitably positioned baffle 27 which deflects them into an intercepting receptacle 13. The bottom portion of the receptacle 13 contains a rotary feed screw 28 which transports the heavier particles (mainly ribs, stem and birds' eyes) to a further processing station, e.g., to a machine for making sheets of reconstituted tobacco. The receptacle 13 also intercepts fragments of metal, rock and/or other foreign matter which might have entered the magazine 3.

The lighter tobacco particles (including short and long shreds as well as particles of dust) have shorter flight spans and descend onto the upper reach of an endless conveyor belt 12 which is driven to move its upper reach in the direction indicated by arrow. The lighter particles form a substantially uniform and relatively wide layer or carpet 14 whose leading end is propelled against a suitably curved stationary side wall 17 so that the lighter particles descend into the range of bristles on the core of a rapidly rotating cylindrical brush 24 serving as a means for accelerating and showering tobacco into an elongated tobacco filler stream forming or building zone defined by a narrow channel 19. The channel 19 is located above a stationary suction chamber 23 having a perforated top wall 22 which supports the upper reach of a narrow foraminous tobacco stream conveying belt 21. The conveyor 12 transports the layer 14 along a second portion of the tobacco path, and the channel 19 defines a third portion of such path.

Tobacco which is showered by the accelerating brush 24 descends onto the upper reach of the conveying belt 21 and forms a continuously growing tobacco stream 16*a* which, when fully grown, forms the aforementioned filler stream 16. The stream of suction air which flows into the chamber 23 insures that tobacco which descends into the channel 19 shares the forward movement of the upper reach of the conveying belt 21. The fully grown filler stream 16 is thereupon equalized by a trimming device 26 which is adjacent to or mounted in the downstream portion of the channel 19. The trimming device 26 equalizes the upper side of the filler stream 16, i.e., that side which is remotest from the upper reach of the belt 21. Certain particles of tobacco dust and/or short tobacco will penetrate through the foraminous belt 21 and through the perforations 22*a* of the top wall 22 to enter the interior of the suction chamber 23 with the air stream flowing across the growing tobacco filler stream 16*a*.

The right-hand portion of the upper reach of the belt 21 delivers the once-equalized filler stream 16 into the circumferential groove of a relatively large tobacco conveying suction wheel 29 whereby the once-equalized side of the filler stream 16 is adjacent to the bottom wall of the groove. Such bottom wall is foraminous and a portion thereof surrounds a stationary suction chamber 31 in the wheel 29. The suction chamber 31 attracts the filler stream 16 to the foraminous bottom wall in the groove of the wheel 29 during travel of the filler stream from the transfer station between 21, 29, past a second trimming device 32, and thereupon to the transfer station between the wheel 29 and a foraminous transfer conveyor 34. The trimming device 32 equalizes that side of the filler stream 16 which is remotest from the foraminous bottom wall in the groove of the suction wheel 29 and thus converts the filler stream into a rod-like filler stream or filler 33. Such filler is attracted to the lower reach of the transfer conveyor 34 which is an endless band or belt the lower reach of which travels along the underside of a suction chamber 35. The belt 21 conveys the filler stream along the aforementioned third portion of the tobacco path. The wheel 29 and conveyor 34 constitute a means for conveying the filler stream along a fourth portion of the tobacco path.

The conveyor 34 transfers the filler 33 onto the upper side of a continuous cigarette paper web 36 which is withdrawn from a bobbin 37 and passes through an imprinting mechanism 38 before it reaches the upper stretch of an endless belt conveyor 39 known as garniture. The mechanism 38 applies to web 36 the trade name of the manufacturer of cigarettes, the brand name of cigarettes and/or other information. The speed of lengthwise movement of the upper stretch of the garniture 39 (and hence of the web 36) equals the speed of forward movement of the filler 33.

The garniture 39 transports the filler 33 and the web 36 through a wrapping mechanism 41 which drapes the web around the filler in such a way that one marginal portion of the web extends tangentially from the partially draped filler and is coated with adhesive (e.g., a wet adhesive) by a suitable paster 42. The thus coated marginal portion of the web 36 is thereupon folded over the other marginal portion to form therewith a seam which extends longitudinally of the resulting continuous cigarette rod 44. The seam is heated by a sealer 43 to promote rapid setting of adhesive. If the adhesive is a hotmelt which is activated in response to heating, the sealer 43 is replaced by a seam cooling device.

The cigarette rod 44 advances toward and through a cutoff 46 which severs the rod at regular intervals so that the latter yields a single file of discrete plain cigarettes of predetermined length, preferably unit length. Successive plain cigarettes of the single file are accelerated by the lobe or lobes of a rapidly rotating cam 47 which propels the cigarettes into successive flutes of a rotary drum-shaped row forming conveyor 48. The conveyor 48 converts the single file of plain cigarettes into one or more rows wherein the cigarettes travel sideways, and such rows are transported to a packing machine, to a tray filling device or to a filter cigarette making machine, not shown.

As mentioned above, the suction chamber 23 below the upper reach of the foraminous belt 21 receives a certain amount of tobacco dust and/or short tobacco. The suction chamber 31 in the suction wheel 29 also receives such relatively small tobacco particles, and the same applies for the suction chamber 35 above the lower reach of the transfer conveyor 34. The outlets of the suction chambers 23, 31, 35 are respectively connected with suction pipes 49, 51, 52 which discharge suction air streams and relatively small tobacco particles into an air collecting pipe 53. The latter delivers tobacco particles and air to a cyclone separator 54 which separates air from tobacco particles and allows the thus separated gaseous carrier medium to enter a pipe 56 which is connected to the suction intake of a fan 60. The outlet of the fan 60 discharges air (which normally contains minute particles of tobacco dust) into a relatively simple filtering unit 57 which intercepts minute particles of tobacco dust and allows the thus cleaned air to escape into the atmosphere.

The separator 54 invariably intercepts short tobacco and larger particles of tobacco dust, and such material is evacuated from its lower portion by way of an air lock here shown as a cell wheel 58 which allows short tobacco and tobacco dust to enter the inlet 59 of a pneumatic conveyor tube 63. The inlet of the tube 63 is further connected with the outlet 61 of a source 62 (e.g., a blower) of compressed air. The tube 63 transports a mixture 55 of short tobacco and larger particles of tobacco dust back into the magazine 3 of the distributor.

As shown in FIG. 2, the conveyor tube 63 discharges compressed air and the particles of the mixture 55 into the lower portion of the magazine 3. This is desirable and advantageous because, as the stream of compressed air issuing from the outlet 64 of the tube 63 rises in the magazine 3, it attempts to entrain the particles of the mixture 55 whereby tobacco 1 which forms the supply 4 acts not unlike a filter and intercepts the mixture 55 so that the latter remains in the magazine 3 and its particles form part of the layer which is withdrawn and transported by the carding of the drum 6. Moreover, such positioning of the outlet 64 of the tube 63 contributes to more uniform distribution of particles of the mixture 55 in the supply 4.

As shown in FIG. 1, the outlet 64 of the pneumatic conveyor tube 63 is relatively wide and is disposed substantially midway between the side walls 10*a*, 10*b* of the distributor housing 10 and marginal portions of the layer 14. This contributes to uniform distribution of mixture 55 in the supply 4. The outlet 64 may constitute a relatively wide nozzle having an elongated slit-shaped orifice through which compressed air and the particles of the mixture 55 enter the lower portion of the magazine 3. It will be noted that the outlet 64 is in register with the growing tobacco filler stream 16*a* which is desirable because such mounting of the outlet 64 insures more uniform distribution of particles which form the mixture 55 throughout the entire growing stream 16*a*. The parts 6, 7, 8, 9, 11, 12, 24 do not necessarily increase the width of the layer of tobacco which is transported from the magazine 3 toward the channel 19.

In accordance with a presently preferred embodiment, and as shown in FIG. 1, the width of the outlet 64 of the conveyor tube 63 is less than the width of the distributor housing 10 and the width of the layer or carpet 14. Consequently, the tube 63 discharges short tobacco and larger particles of tobacco dust onto a base or lower stratum which is immediately adjacent to the upper side of the upper reach of the foraminous belt 21 in the channel 19 and which consists of relatively long tobacco shreds. Such base or lower stratum prevents migration of particles of the mixture 55 toward, into and through the upper reach of the belt 21, i.e., the material of the base constitutes a filter which intercepts the particles of the mixture 55 or simply holds them at a certain distance from the belt 21. The particles of the mixture 55 are thereupon overlapped by a layer or stratum of relatively long tobacco shreds which descend in the region 70 shown in FIG. 1 so that the particles of the mixture 55 are confined between the aforementioned base and a top stratum, both consisting of long shreds. This insures that the first trimming device 26 does not comminute the particles which have been admitted by the tube 63; the trimming device 26 preferably removes or severs relatively long shreds which form the aforementioned top stratum of the fully grown tobacco filler stream 16. In fact, if the width of the outlet 64 is properly related to the width of the shower which is propelled by the brush 24, and if the distance between the ends of the outlet 64 and the walls 10*a*, 10*b* is properly selected by the assembler, the equalizing element or elements of the trimming device 26 will not reach and will not remove any material of the mixture 55. This is desirable because severing of the particles which form the mixture 55 would result in formation of at least some minute particles of tobacco dust which would be unsuited for renewed introduction into the magazine 3 of the distributor. It is customary to return into the magazine 3 all such tobacco which has been removed by the trimming device 26 and/or 32.

An advantage of the aforementioned top stratum which consists of long tobacco shreds and overlies the particles of the mixture 55 supplied by the tube 63 is that the long shreds of the upper stratum overlie the material of the mixture 55 in the once-trimmed filler stream 16 and thus prevent short tobacco and larger particles of tobacco dust from migrating toward and from entering the suction chamber 31 during travel of the filler stream 16 in the circumferential groove of the suction wheel 29.

The second trimming device 32 preferably removes relatively long tobacco shreds which form the aforementioned base so that the particles of the mixture 55 which form a median layer in the once-trimmed filler stream 16 do not become exposed during conversion of the filler stream into filler 33. This, in turn, insures that the particles of the mixture 55 cannot migrate toward and cannot enter the suction chamber 35 during transport of the filler 33 by the conveyor 34. In other words, the particles which form the mixture 55 remain confined in the interior of the filler stream 16 as well as in the interior of the rod-like filler 33.

The embodiment of FIGS. 1–2 exhibits the advantage that the admission of particles 55 into tobacco 1 is highly unlikely to result in generation of additional tobacco dust.

Figure 3:
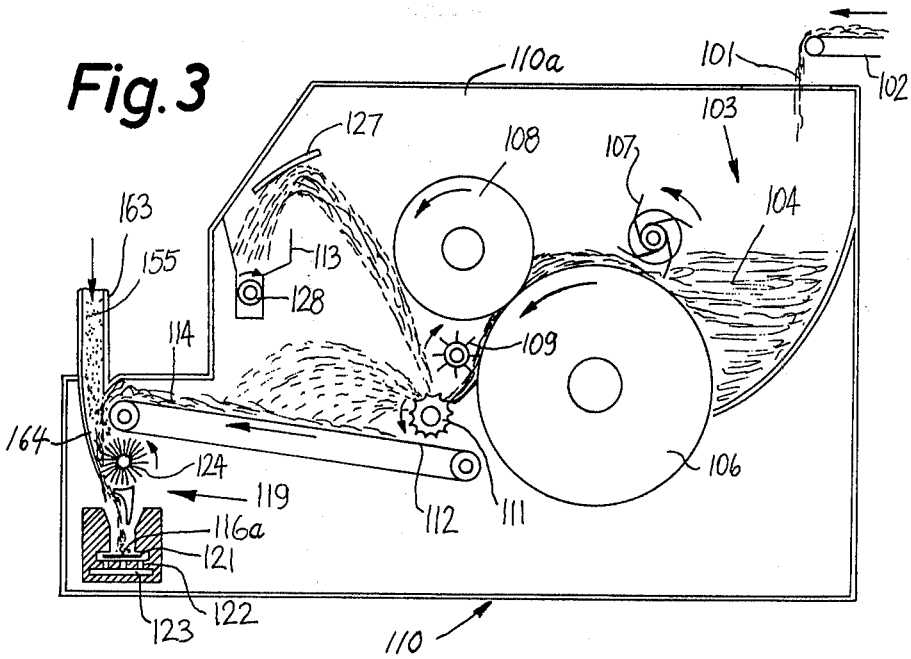
FIG. 3 is a similar sectional view of a second distributor.

FIG. 3 shows a portion of a second cigarette making machine wherein all such parts which are identical with or clearly analogous to corresponding parts of the machine shown in FIGS. 1–2 are denoted by similar reference characters plus 100. The manner in which the machine collects a mixture 155 of short tobacco and heavier or larger tobacco dust particles is preferably the same as shown in and described in connection with FIGS. 1–2. However, the pneumatic conveyor tube 163 of FIG. 3 has an outlet 164 which delivers successive increments of the mixture 155 into the range of bristles on the core of the rotary accelerating brush 124 or directly into the channel 119. The width and positioning of the outlet 164 with respect to the side walls (only the side wall 110*a* shown in FIG. 3) of the distributor housing 110 are preferably the same as shown in FIG. 1 for the outlet 64 of the conveyor tube 63.

The outlet 164 of the tube 163 can propel the particles of the mixture 155 directly onto the central portion of the carpet or layer 114 which is transported by the upper reach of the belt conveyor 112.

The machine of FIG. 3 also insures that at least some particles of the mixture 155 enter the median or central portion of the growing tobacco filler stream 116*a* and are prevented (by adjacent strata consisting of long tobacco shreds) from entering the suction chambers corresponding to chambers 23, 31 and 35 of FIG. 1, i.e., the long shreds furnish a highly desirable filtering action and retain some or all particles of mixture 155 in the central region of the filler stream and filler.

Figure 4:
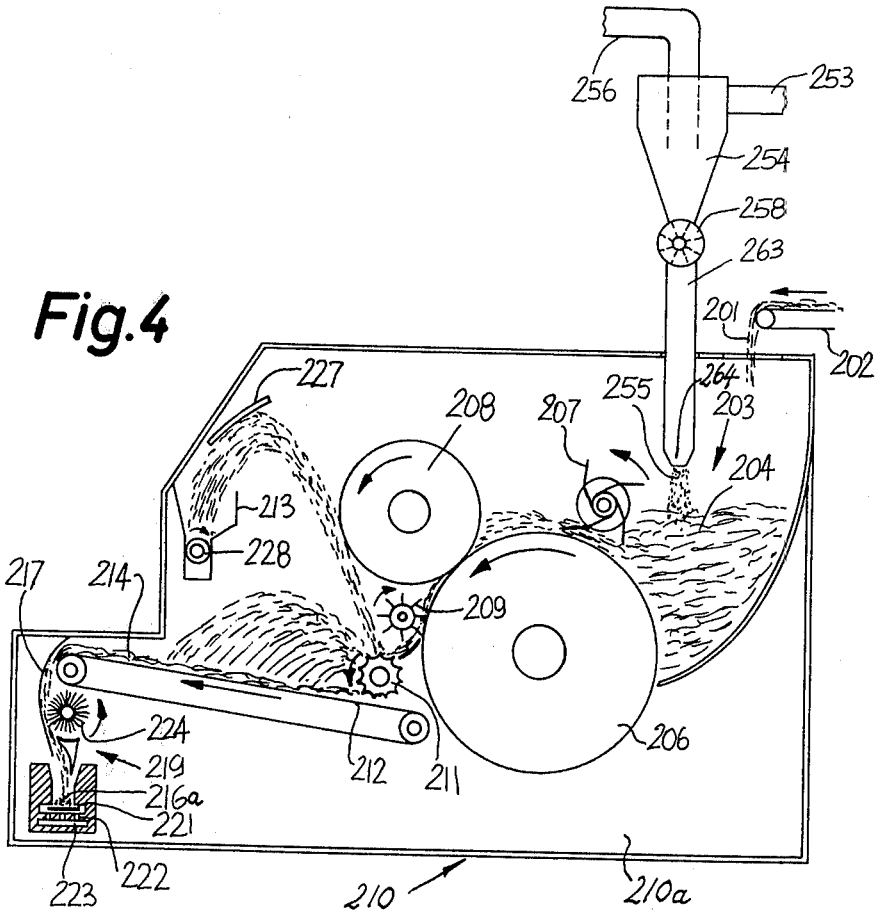
FIG. 4 is a similar sectional view of a third distributor.

FIG. 4 shows a portion of a third machine wherein all such parts which are identical with or clearly analogous to corresponding parts of the first machine are denoted by similar reference characters plus 200. The relatively wide outlet 264 of the conveyor tube 263 sprinkles the particles of the mixture 255 onto the upper surface of tobacco supply 204 in the magazine 203. The blower 62 of FIG. 1 can be omitted because the tube 263 is vertical or substantially vertical and its upper end portion receives tobacco particles of the mixture 255 directly from the air lock 258. Thus, particles of the mixture 255 can descend by gravity. The width and the position of outlet 264 with respect to the side walls (only the side wall 210*a* shown in FIG. 4) of the distributor housing 210 are preferably similar to or identical with the arrangement shown in FIG. 1.

An important advantage of the improved method and machine is that short tobacco and relatively large particles of tobacco dust (both of which are acceptable in the filler of a cigarette or an analogous smokers' product) can be introduced into the growing tobacco filler stream in such a way that they are unlikely to be removed during growing of the stream, during subsequent conversion into a filler and/or during draping of the filler into a web of cigarette paper or other suitable wrapping material. Short tobacco and particles of tobacco dust invariably develop during transport of comminuted tobacco and during conversion of such tobacco into a filler so that their introduction into the filler stream contributes to savings in tobacco and to a more satisfactory "feel" of smokers' products, i.e., a person holding a cigarette in his or her hand gains the impression that the tubular wrapper contains a compact filler.

Another important advantage of the improved method and machine is that recirculation of tobacco shorts and larger particles of tobacco dust relieves the filtering unit which, in many presently known machines, must be designed to intercept and segregate minute particles of tobacco dust, larger particles of tobacco dust as well as short tobacco. Thus, the filtering unit 57 of FIG. 1 can be simplified and the filtering material therein requires less frequent replacement or cleaning because this unit merely serves to intercept very small particles of tobacco dust which are not desirable in the filler of a cigarette or the like but must be intercepted nevertheless in order to avoid contamination of the plant and penetration of minute dust particles into sensitive components of cigarette testing apparatus or the like. Still further, the intercepted minute particles of tobacco dust can be used in the manufacture of reconstituted tobacco.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed is:

1. A method of making a continuous tobacco filler stream, comprising the steps of accumulating and maintaining — in a first portion of a predetermined path — a supply of tobacco which contains relatively large particles and relatively small particles including short tobacco and smaller and larger particles of tobacco dust; withdrawing from said supply a continuous layer of tobacco and transporting said layer along a second portion of said path; showering the tobacco of said layer into an elongated stream building zone constituting a third portion of said path to thereby convert said layer into said filler stream; conveying said filler stream lengthwise along said third and thereupon along a fourth portion of said path; conveying at least one suction air stream across at least one of said portions of said path whereby at least some relatively small particles of tobacco become segregated from the remaining particles and leave said one portion with said air stream; separating at least some relatively small particles from said air stream; and introducing the thus separated relatively small particles directly into at least one selected portion of said path.

2. A method as defined in claim 1, wherein said introducing step comprises conveying the separated relatively small particles in a second air stream and directing said second air stream against one side of tobacco in said selected portion of said path so that the air of said second air stream passes through tobacco in said selected portion of said path and the tobacco in said selected portion filters the relatively small particles from the second air stream.

3. A mehtod as defined in claim 1, wherein said one portion is one of said third and fourth portions of said path.

4. A method as defined in claim 1, wherein said separating step includes removing from the air stream at least the majority of short tobacco and/or larger particles of tobacco dust.

5. A method as defined in claim 1, wherein said selected portion is said first portion of said path.

6. A method as defined in claim 1, wherein said introducing step comprises conveying said separated relatively small particles in a stream of compressed gaseous carrier medium.

7. A method as defined in claim 6, wherein said selected portion is one of said first, second and third portions of said path.

8. A method as defined in claim 6, wherein said selected portion is said first portion of said path.

9. A method as defined in claim 8, wherein said introducing step further comprises directing said stream of compressed gaseous carrier medium against the underside of said supply so that the medium rises in and the tobacco of said supply intercepts the relatively small particles.

10. A method as defined in claim 1, wherein said selected portion is said third portion of said path.

11. A method as defined in claim 1, wherein said selected portion is said first portion of said path and said introducing step includes depositing the separated relatively small particles on top of said supply.

12. A method as defined in claim 1, wherein said introducing step includes admitting the relatively small particles into an intermediate part of the filler stream so that such relatively small particles are flanked by strata of relatively large particles of tobacco not later than in said fourth portion of said path.

13. A method as defined in claim 1, comprising conveying at least one suction air stream across each of said third and fourth portions of said path.

14. In a machine for making a continuous tobacco filler stream, a combination comprising a magazine occupying a first portion of a predetermined path; means for feeding into said magazine tobacco which contains relatively large particles and relatively small particles including short tobacco and smaller and larger particles of tobacco dust so that said magazine accumulates a supply of tobacco; means for withdrawing from said magazine a continuous layer of tobacco; means for transporting said layer along a second portion of said path and for showering the tobacco of said layer into an elongated stream building zone constituting a third portion of said path wherein the tobacco thus showered is converted into said filler stream; means for conveying said filler stream lengthwise along said third and thereupon along a fourth portion of said path; means for conveying at least one suction air stream across at least one of said portions of said path whereby at least some relatively small particles of tobacco become segregated from the remaining particles and leave said one portion of said path with said air stream; means for separating at least some relatively small particles from said air stream; and means for introducing the thus separated relatively small particles directly into at least one selected portion of said path.

15. A combination as defined in claim 14, wherein said introducing means comprises a pneumatic conveyor.

16. A combination as defined in claim 14, wherein said one portion is at least one of said third and fourth portions of said path and said first mentioned conveying means comprises at least one foraminous conveyor for said filler stream, said last mentioned conveying means comprising a suction chamber adjacent to said foraminous conveyor.

17. A combination as defined in claim 14, wherein said magazine has an upper portion and a lower portion and said introducing means comprises a pneumatic conveyor tube having an outlet communicating with said lower portion of said magazine.

18. A combination as defined in claim 14, further comprising an elongated channel defining said stream building zone, said introducing means including a pneumatic conveyor having an outlet which discharges separated particles into said channel.

19. A combination as defined in claim 14, wherein said introducing means has an outlet above the supply of tobacco in said magazine.

20. A combination as defined in claim 14, wherein said magazine and said withdrawing and transporting means form part of a tobacco distributor and said introducing means has an outlet which discharges said separated particles into one of said first, second and third portions of said path.

21. A combination as defined in claim 20, wherein said outlet discharges said separated particles into that part of said selected portion of said path which contains tobacco about to form an intermediate layer of said filler stream.

22. A combination as defined in claim 21, wherein said outlet is located intermediate the marginal portions of said layer.

* * * * *

UNITED STATES PATENT OFFICE

CERTIFICATE OF CORRECTION

Patent No. 4,003,385 Dated January 18, 1977

Inventor(s) Klaus ADEBAHR and Jürgen GÖMANN

It is certified that error appears in the above-identified patent and that said Letters Patent are hereby corrected as shown below:

Foremost page, item [75], lines 1-2, "Jurgen Gomann"

should read --Jürgen Gömann--;

item [73], "Hauni-Werke Korber & Co., KG,"

should read --Hauni-Werke Körber & Co. KG,--;

item [30], line 2, "1974" should read --1975--.

Col. 2, line 47, "consturction" should read --construction--.

Claim 3, line 30, "mehtod" should read --method--.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*